United States Patent [19]

Mauck

[11] Patent Number: 4,464,132

[45] Date of Patent: Aug. 7, 1984

[54] LIFE PRESERVER

[76] Inventor: Lee E. Mauck, 8155 E 46th, Tulsa, Okla. 74145

[21] Appl. No.: 407,803

[22] Filed: Aug. 13, 1982

[51] Int. Cl.[3] ..... B63C 9/08

[52] U.S. Cl. ..... 441/81

[58] Field of Search ..... 441/80–84, 441/88–89, 108, 129, 130–132

[56] References Cited

U.S. PATENT DOCUMENTS

| | | | |
|---|---|---|---|
| 2,246,108 | 6/1941 | Sermon | 441/131 |
| 2,529,961 | 11/1950 | Phillips | 441/131 |
| 3.095,586 | 7/1963 | Baier | 441/81 |

FOREIGN PATENT DOCUMENTS

| | | | |
|---|---|---|---|
| 84688 | 12/1954 | Norway | 441/81 |

*Primary Examiner*—Trygve M. Blix
*Assistant Examiner*—Jesûs D. Sotelo
*Attorney, Agent, or Firm*—Head, Johnson & Stevenson

[57] ABSTRACT

A life preserver comprising a buoyant toroidal body having spaced yieldable strap members surrounding at least a portion of the toroidal body, a length of rope extending around the inner periphery of the toroidal body and passing through the central portions of the strap members whereby the rope is maintained in a normal stowage position substantially adjacent the inner periphery of the toroidal body, the rope having the opposite ends thereof extending radially outwardly beyond the outer periphery of the toroidal body and through a passageway for connection with a retrieving cable whereby the rope may be moved radially inwardly against the force of the yieldable strap members to snugly engage the body of a victim disposed within the interior or central opening of the toroidal body to facilitate rescue of the victim without assist from the victim himself.

10 Claims, 5 Drawing Figures

LIFE PRESERVER

BACKGROUND OF THE INVENTION

1. Field of the Invention

This invention relates to improvements in life saving devices and more particularly, but not by way of limitation to a life preserver for facilitating the rescue of a substantially helpless person.

2. Description of the Prior Art

Life saving apparatus in the form of flotation devices are well known and are widely used in areas surrounding water, such as swimming pools, lakes, beaches and the like. These devices are usually carried on water craft, also, for water rescue services. The presently available devices of this type are normally buoyant members adapted to be grasped by the person being rescued, such as the well known toroidal shaped life preserver, and other apparatus such as shown in the Sipos U.S. Pat. No. 1,780,986, issued Nov. 11, 1930 and entitled "Protective Device;" the Walters U.S. Pat. No. 3,088,251, issued July 27, 1937 and entitled "Lifesaving Device;" the Spanner U.S. Pat. No. 2,344,652, issued Mar. 21, 1944, and entitled "Lifesaving Apparatus;" and the Cornforth U.S. Pat. No. 4,056,861, issued Nov. 8, 1977, and entitled "Buoyant Life-Saving Device." The Sipos protective device is of a substantially annular configuration designed primarily for use by skaters and intended to protect skaters from immersion upon breaking through the ice. The device is worn around the body and is tiltable into an inclined position so that persons may pass each other in close proximity, and is provided with an outer ring to engage the ice and is also buoyant to support the person. In addition, a hook means may be thrown a distance on ice sufficiently solid for supporting the person, and the person may draw himself onto firm ice.

The Walter lifesaving device is of an elongated configuration having pointed ends and is buoyant sufficiently for sustaining the weight of a human body submerged in water. It is particularly designed to facilitate towing of the device through water. Cables are provided on the device which may be passed over the shoulder or the like of a lifeguard, who may then swim with arms and legs unimpeded. The loops formed by the ropes or cables may be placed around the chest and shoulders of an exhausted or half-drowned bather, and the bather may be supported by the device while the rescuer goes to the relief of others, or until the device is towed to the shore.

The Spanner lifesaving apparatus is of a substantially hollow square configuration and is of a buoyant construction. A plurality of seats are provided around the outer periphery of the device which are arranged whereby they take up a stable position when the device is in the water. A person may be supported by the float by sitting astride one of the seats. In addition, looped rope harness means to encircle persons is provided the ropes being of buoyant construction. The Cornforth lifesaving device is adapted to be thrown to swimmers, and consists of a buoyant member loosely confined within a net-like web. The web, also being buoyant, permits ready grasping of the device by the swimmer, and also facilitating the accurate throwing or casting of the device through a considerable distance with safety.

These devices have certain disadvantages in that a person in distress in the water, such as a seriously injured or severely weakened person, frequently does not have the strength or ability to grasp a life-saving device, even when it is thrown or cast substantially in his exact location in the water. In addition, persons being rescued, such as in a sea-air rescue attempt, are frequently in the water at positions remote from any beach area, or the like, and it is substantially impossible for a rescuer to reach the injured person in time to prevent his drowning. Such an instance may be the result of an aircraft crash at sea. When the presently available life preserving devices are thrown to the injured and weary passengers struggling for life, they may be able to hold onto the buoyant devices for a period of time, but frequently they become so weakened that they lose their grasp and slip under the water before the rescuers can reach them.

SUMMARY OF THE INVENTION

The present invention contemplates a novel life preserver which has been particularly designed and constructed for overcoming the foregoing disadvantages. The novel device is of a substantially annular configuration, and is of a buoyant construction such as in the present day life preservers of this type. A plurality of elastic or yieldable resilient straps or bands extend around the cross sectional circumference of the preserver body and are spaced around the circumference thereof. A rope means or the like is disposed around the inner periphery of the annular or torodial body and is threaded through the inner portions of the bands whereby the rope is held in a normal position substantially against the body of the device. Each end of the rope extends radially outwardly through the body and each end is secured to a suitable ring member which may be engaged by a towing rope. When the device reaches the injured person, he may place it around his body, or around an arm, or substantially any limb of the body, and upon the application of towing pressure by the towing rope, the inner rope of the device will be pulled tightly against the portion of the person's body which is disposed within the interior of the annular lifesaving device. The yieldable nature of the bands restraining the inner rope means permits the rope to flex or move into the snug body engaging position with respect to the person being rescued, and even if the person falls unconscious, the injured body will be held firmly within the life preserver. The preserver supporting the injured person may be towed to a rescue vessel, or may be lifted through the air to a rescuing aircraft. When the body is released from the life preserver, the elastic nature of the bands will return the securing inner rope to the normal position thereof substantially against the inner periphery of the annular life preserver. The improved life preserver of the invention may be an independent structure incorporated in a buoyant annular body, or may be an attachment for securing to an already available annular life preserver such as frequently used in rescue operations of this type. The novel life preserver is simple and efficient in operation and economical and durable in construction.

DETAILED DESCRIPTION OF THE PREFERRED EMBODIMENTS

Figure 1:
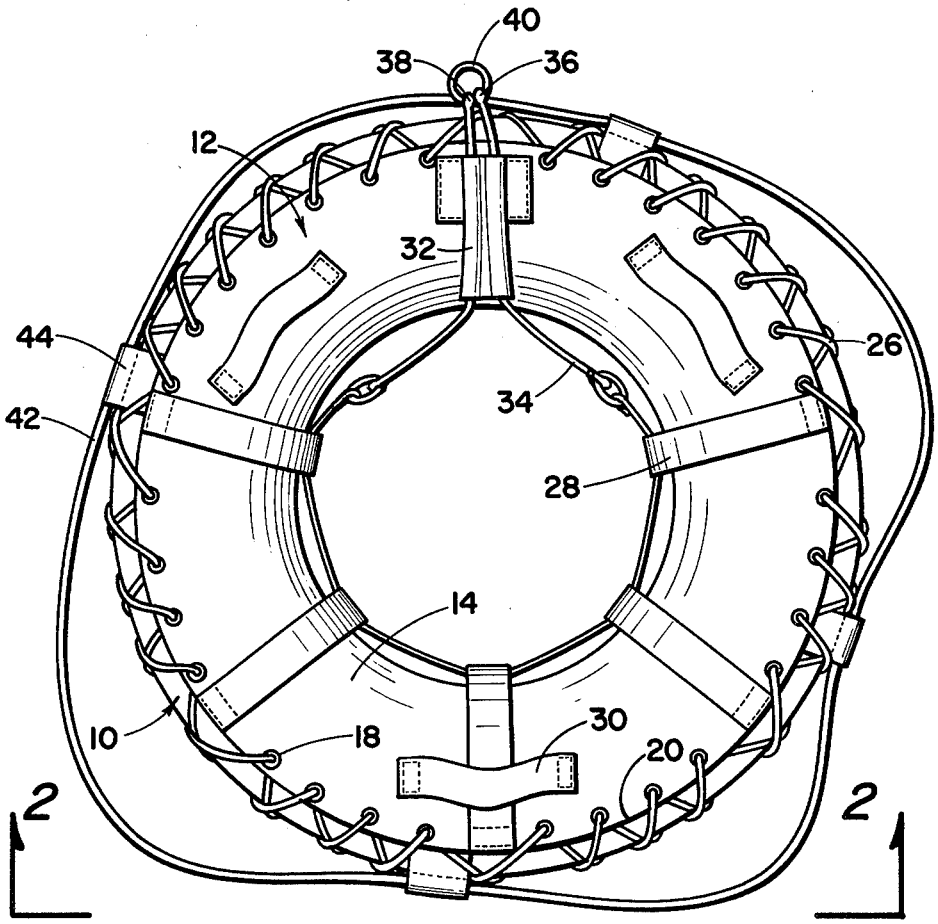
FIG. 1 is a plan view of a life preserver embodying the invention, illustrating a normal storage position therefor.
Figure 2:
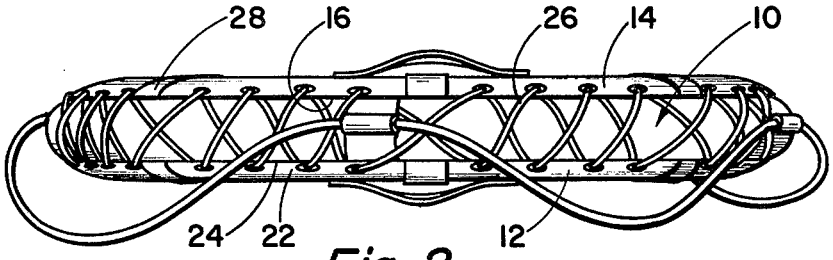
FIG. 2 is a view taken on line 2—2 of FIG. 1.
Figure 3:
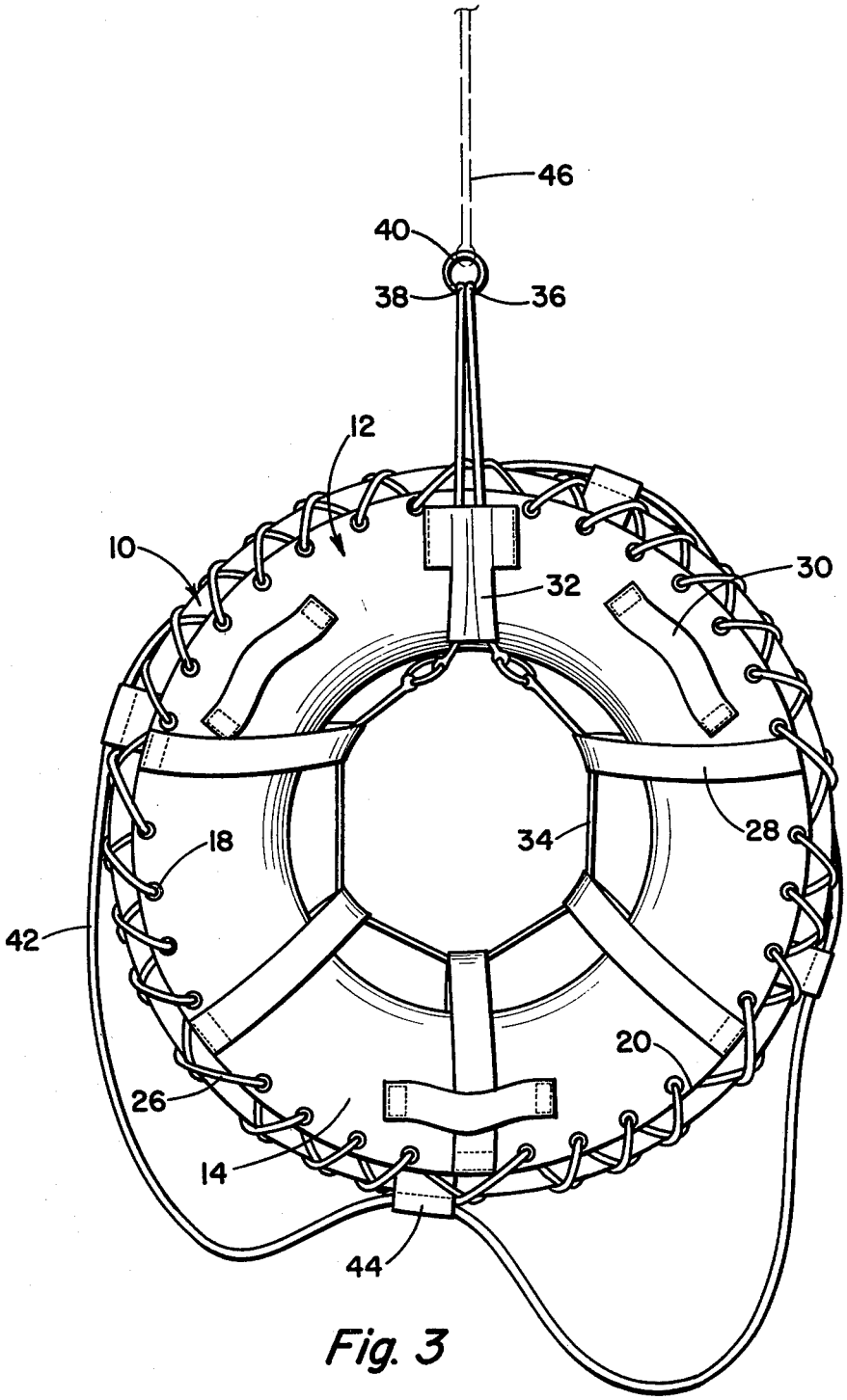
FIG. 3 is a view of a life preserver embodying the invention, illustrating a position therefor as used in a life saving situation.

Referring to the drawings in detail, and particularly FIGS. 1, 2 and 3, reference character 10 generally indicates any suitable life preserver of the usual or well knwon toroidal configuration constructed from any suitable or well known buoyant material and having an adapter 12 secured thereto for converting the life preserver 10 into a life preserver embodying the present invention. The adapter 12 comprises a scrim or cover 14 removably secured about at least a portion of the outer periphery of the toroidal life preserver 10 the cover 14 preferably being constructed from any suitable material which is sufficiently pliable as to wrap around and substantially conform to the contour of the body 12, as clearly shown in FIGS. 1, 2 and 3, and which is resistant to damage from water or other atmospheric conditions frequently encountered during the use of devices of this type. The overall width of the cover 14 is preferably of a dimension as to provide a hiatus 16 (FIG. 2) around the outer circumference of the body 12 and between the opposite ends or edges of the cover. Whereas the cover 14 may be removably secured around the outer surface of the body 12 in any suitable manner, it is preferable to provide a plurality of spaced ports or eyelets 18 around one edge 20 of the cover 14 and a plurality of similarly spaced ports or eyelets 22 around the opposite edges 24 thereof. A suitable tie or cable means 26 may be laced through and between the ports 18 and 22 for securing the cover 14 about the outer surface of the body 12, with the edges 20 and 24 preferably in spaced relation as hereinbefore set forth, but not limited thereto.

A plurality of yieldable straps or bands 28 which may be constructed from elastic or the like, are secured to the outer surface of the cover 14 in circumferentially spaced relation. Whereas the straps 28 may be secured to the cover in any suitable manner, it is preferable to attach the opposite ends of each band in the proximity of the outer edges 20 and 24 of cover 14 whereby central portions of the straps 28 are unattached or free with respect to the cover. It will be readily apparent that the straps 28 extend transversely about the body 12 with the central portions of the straps 28 being disposed at the inner periphery of the toroid. The yieldable nature of the straps maintains the straps in a normal position substantially against the body 12, but permits flexing of the straps in a radially inward direction for a purpose and in a manner as will be hereinafter set forth. In addition to the straps 28, it is preferable to provide a plurality of spaced hand grip members 30 on the outer surface of the cover 14 for facilitating grasping of the device 10, as will be hereinafter set forth. The hand grip members 30 may be constructed from any suitable material and secured to the cover 14 in any suitable manner, but as shown herein, the elements 30 are preferably constructed from a nylon webbing material, and the opposite ends of each element 30 may be stitched or otherwise secured to the cover 14. The central portion of each element 30 is preferably spaced outwardly from the cover 14 for facilitating manual grasping of the element 30 when desired.

A suitable sleeve or channel means 32 is secured to the cover 14 in any well known manner for slidably receiving the opposite ends of a cable or rope means 34 therethrough, as particularly shown in FIGS. 1 and 3. The rope 34 is preferably nylon rope, or other buoyant and weather resistant material, but not limited thereto, and is threaded through the inner or central portions of the straps 28. The rope means 34 may be a continuous length of rope, with the opposite or outer ends 36 and 38 thereof extending outwardly from the outer end of the sleeve 32, or may comprise a plurality of rope lengths secured in end-to-end relation, as desired. The outer ends 36 and 38 are secured to a metallic ring 40 for a purpose as will be hereinafter set forth. In the normal stowage or non-use position for the device 10, the elastic or yieldable nature of the strap members 28 holds the rope means 34 substantially against the inner periphery of the toroid, as particularly shown in FIG. 1. The yieldable nature of the straps 28, however, permits the rope means 34 to be pulled radially inwardly during use of the device 10, as will be hereinafter set forth and as particularly shown in FIG. 3. When desired, a suitable retrieving means or tow rope means 46 may be secured to the ring 40 for facilitating the application of longitudinal tension on the rope means 34 to provide said radial inward movement.

The body 12 as shown herein is also preferably provided with the usual maneuvering rope or cable means 42, which may be loosely but securely secured around the outer circumference of the toroid in any well known manner, such as by the usual fastening means 44 normally secured directly to the body 12. The rope means 42 facilitates the casting or throwing of the device 10 to a struggling person or into the proximity of a person to be rescued by the device 10, as is well known.

In use, the device 10 may be utilized in the normal manner of the well known toroidal life preservers, and the like, during relatively normal rescue operations wherein the conditions warrant such normal usage. However, in the event the person being retrieved or rescued has been injured to such an extent or is weakened whereby he cannot maintain a grasp or hold onto the device 10, the device may be utilized for emergency rescue in the following manner:

The device 10, having the adapter 12 provided thereon, may be cast, thrown, dropped, personally delivered or otherwise deposited in the proximity of the injured person whereby the device may be positioned about his body in such a manner that the toroidal configuration of the life preserver 10 surrounds his torso, or other part of his anatomy, such as an arm. The retrieving line or rope 46 may be pulled for transmitting a longitudinal force along the length of the rope means 32, causing the rope means 34 to move radially inwardly against the force of the yieldable or elastic straps 28. The rope means 34 is thus drawn tightly about the torso, or other body portion engaged by the device 10 for securely retaining the injured person being rescued in the device 10, regardless of whether or not the person himself is able to grasp the device. Of course, when the rescued person is removed from the device 10, the elastic or yieldable nature of the strap means 28 automatically pulls or draws the rope means 34 into the normal stowage position thereof whereby the device 10 is in a "ready condition" for use in a subsequent rescue operation.

Such a rescue operation is of particular value in an air-sea rescue attempt in that the hoisting apparatus (not shown) normally provided in the aircraft utilized during the rescue operation may be actuated for lifting the device 10 carrying the injured person from the water and into the rescue craft. The loss of the person from the device during such a rescue operation is substantially eliminated since the device automatically clasps the person securely within the rescue device 10 until he may be retied by the rescue personnel.

Whereas the adapter 12 shown in FIGS. 1, 2 and 3 may be applied to substantially any existing toroidal type life preserver, it is to be noted that the toroidal body 10 itself may be initially contructed in such a manner that the yieldable strap means 28 is integrally secured thereto, and the opposite ends of the rope means 34 may pass through a radial passageway (not shown) provided in the body 10 rather than through the channel means 32 as shown herein.

Figure 4:
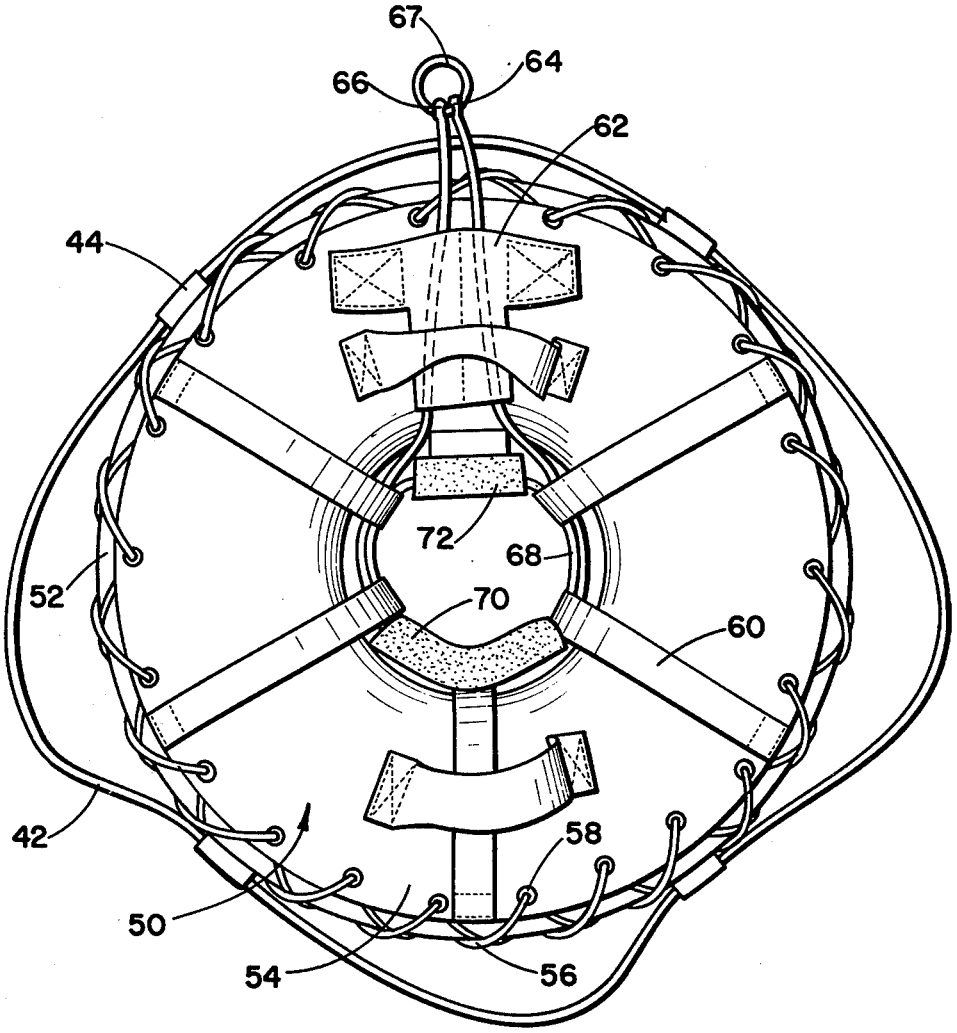
FIG. 4 is a plan view of a modified life preserver embodying the invention, illustrating a normal storage position therefor.
Figure 5:
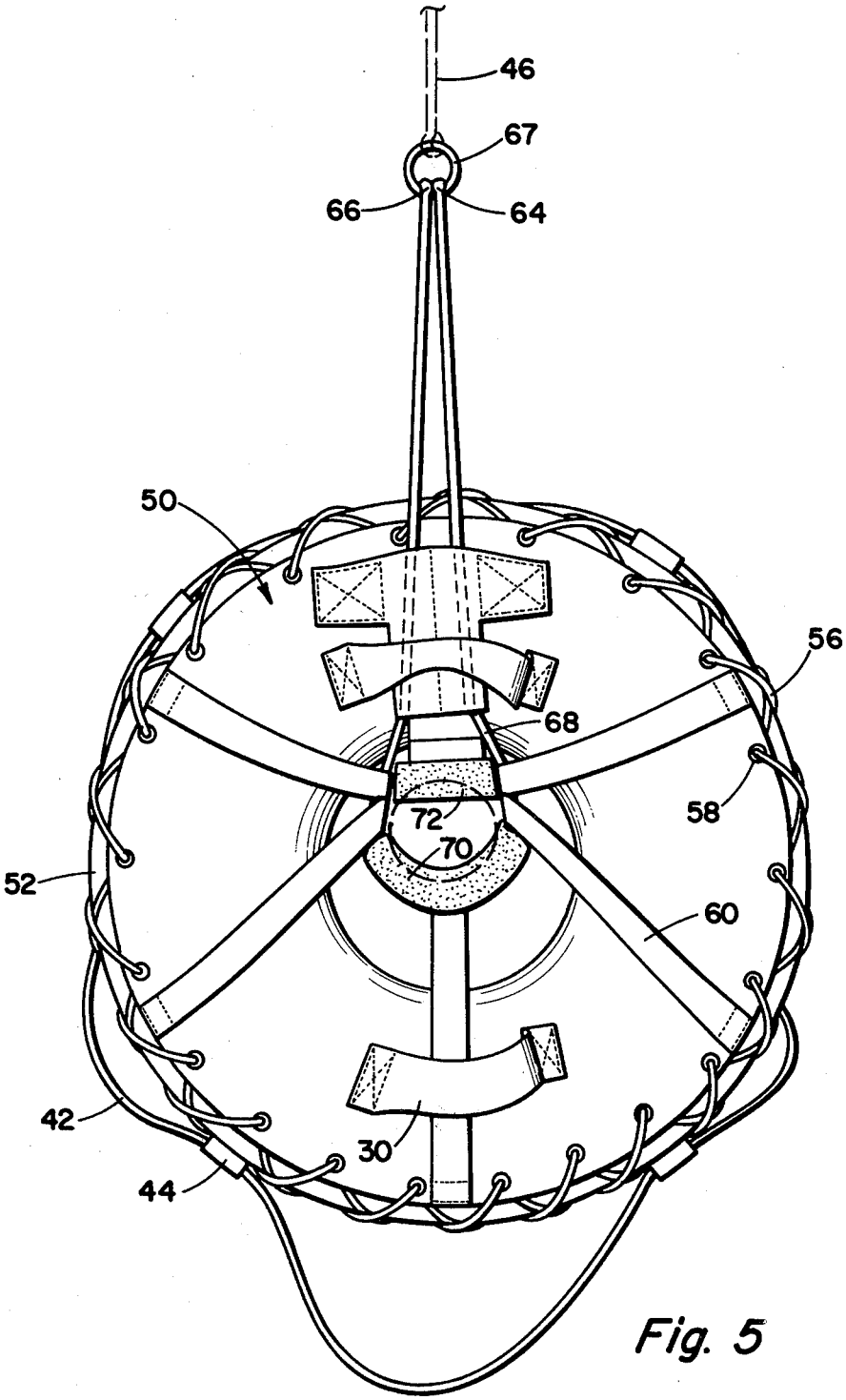
FIG. 5 is a view of the life preserver shown in FIG. 4, illustrating a position therefor as used in a life saving situation.

Referring now to FIGS. 4 and 5, a modified adapter generally indicated at 50 is shown which may be removably secured to substantially any suitable life preserver 52 of a toroidal configuration. The adapter 50 is generally similar to the adapter 12 and comprises a cover 54 adapted to cover at least a portion of the outer surface of the body 52. The cover 54 may be secured in position in any suitable manner, such as by the lacing of a suitable cable or rope means 56 through a plurality of spaced ports or apertures 58 as in the manner of the cover 14 hereinbefore set forth. In addition, yieldable strap means 60 may be secured to the scrim or cover 54 in the same manner and to perform the same function as the strap means 28. Channel or sleeve means 62 is secured to the outer surface of the cover 54 for receiving the opposite ends 64 and 66 of rope means 68 therethrough. The rope means 68 is threaded through or passes through the yieldable straps members 60 and is operable in the same manner as the rope means 34. The ends 64 and 66 may be suitably secured to a suitable metallic ring 67, and the retrieving rope means 46 may be secured to the ring 67 in the same manner as hereinbefore set forth with respect to the ring 40, and for the same purpose.

First pad or cushioning means 70 is suitably secured to the rope means 68, and preferably is interposed between two of the strap members 60 whereby the pad 70 is disposed substantially diagonally from the sleeve means 62. In addition, second pad or cushioning means 72 is secured to the rope means 68 in any suitable manner, and is preferably disposed in the proximity of the sleeve means 62, but not limited thereto. The pad members 70 and 72 move radially inwardly and outwardly with the actuation of the rope means 68.

As shown in FIG. 4, the normal stowage position for the rope means 68 and pads 70 and 72 is in the proximity of the inner periphery of the toroidal body 52. When the device 50 is to be utilized for rescue of a weakened person, or the like, as hereinbefore set forth, the device may be positioned about the torso or other body portion of the victim and upon the application of pressure on the tow or retrieval line 46, the rope means 68 is drawn radially inwardly as shown in FIG. 5 for firmly engaging the torso or other body portion of the victim and securely retaining the person in the device 50. The pads 70 and 72 are brought into engagement with the victim's body portion as the rope means 68 is drawn radially inwardly, thus substantially precluding injury to the body portion engaged thereby during the rescue attempt or operation. Of course, when the victim is removed from the device 10, the normal yieldable characteristic of the strap members 60 will return the rope means 60 and pads 70 and 72 to the normal stowage positions therefor whereby the device is ready for use in a subsequent rescue operation.

From the foregoing it will be apparent that the present invention provides a novel life preserver device which may be utilized in the normal manner of toroidal devices of this type, but which is particularly designed and constructed for automatically engaging the body or body portion of a victim being rescued thereby for sustaining the victim even when he is so greatly injured or is so weakened that he cannot cling to the device of his own power. The novel device comprises body grasping rope means secured within the central opening of the toroidal configuration of the preserver by means of yielding strap members whereby application of a force along the length of the rope means draws the rope means tightly about the body or body portion of the victim for securely retaining the victim in the device until he may be retrieved therefrom. The rope means is automatically restored to a stowage position upon removal of the victim therefrom whereby the device is in a "ready condition" for the next succeeding rescue operation.

Whereas the present invention has been described in particular relation to the drawings attached hereto, it should be understood that other and further modifications, apart from those shown or suggested herein may be made within the spirit and scope of this invention.

What is claimed is:

1. A life preserver comprising a buoyant toroidal body, resilient band means secured radially around at least a portion of the cross sectional circumference of the body and having the central portion thereof free with respect to the body, rope means encircling the inner periphery of the toroidal body and threaded between the body and the free portion of the band means, channel means extending radially with respect to the body to provide communication between the interior and exterior of the toroidal body, the rope means having outer ends extending slidably through the channel means and terminating exteriorly of the body, and means engagable with the outer ends of the rope means for selectively drawing the rope means radially inwardly against the force of the resilient band means for secure engagement with a victim disposed within the interior of said toroidal body.

2. A life preserver as set forth in claim 1 and including cover means wrapped around at least a portion of the toroidal body and removably secured thereto, and said resilient means and channel means are secured to said cover means.

3. A life preserver as set forth in claim 1 wherein the resilient band means comprises a plurality of spaced resilient strap members, each strap member having the opposite ends secured and the central portions thereof free for receiving the rope means therethrough, the resilient strap members retaining the rope mean in a normal stowage position substantially against the inner periphery of the toroidal body.

4. A life preserver as set forth in claim 1 and including cushion means secured to the rope means for facilitating engagement of the rope means with the victim.

5. A life preserver as set forth in claim 1 wherein the outer ends of the rope means are secured to a metallic ring for facilitating drawing of the rope means radially inwardly.

6. A life preserver as set forth in claim 1 and including hand grip means for facilitating manual manipulation of the life preserver.

7. A life presever as set forth in claim 6 wherein the hand grip means comprises at least one strap member constructed from a substantially weather proof material.

8. Cover means for a toroidal life preserver and comprising a scrim removably secured to and covering at least a portion of the outer surface of the life preserver, resilient strap means secured to the scrim and extending about at least a portion of the cross sectional circumference of the life perserver, channel means secured to the scrim, rope means encircling the inner periphery of the toroidal life preserver and having outer ends extending slidably through the channel means, the rope means being passed through the central portion of the strap means and responsive to longitudinal pressure applied along the length of the rope means for moving radially inwardly against the force of the strap means for firmly engaging an object disposed within the interior of the toroidal life preserver.

9. Cover means as set forth in claim 8 wherein the resilient strap means comprises at least one yieldable strap member having the opposite ends secured in the proximity of the outer edges of the scrim and the central portion thereof free with respect to the scrim for receiving the rope means thereunder.

10. Cover means as set forth in claim 8 and including cushion means secured to the rope means for facilitating engaging of said object.

* * * * *